US008499674B2

(12) United States Patent
Holba et al.

(10) Patent No.: US 8,499,674 B2
(45) Date of Patent: Aug. 6, 2013

(54) YOKE ACCESSORY TOOL FOR AN OSCILLATING TOOL

(75) Inventors: John Holba, Naperville, IL (US); Edward Abante, Chicago, IL (US); Jeremy Rubens, Palatine, IL (US); Carl Christian Carlson, Vernon Hills, IL (US); Jaime Moreno, Arlington Heights, IL (US)

(73) Assignee: Robert Bosch GmbH, Stuttgart (DE)

( * ) Notice: Subject to any disclaimer, the term of this patent is extended or adjusted under 35 U.S.C. 154(b) by 496 days.

(21) Appl. No.: 12/887,682

(22) Filed: Sep. 22, 2010

(65) Prior Publication Data

US 2012/0066919 A1 Mar. 22, 2012

(51) Int. Cl.
*B27B 19/02* (2006.01)

(52) U.S. Cl.
USPC ..... 83/782; 83/746; 83/542; 30/166.3; 30/513

(58) Field of Classification Search
USPC ..... 83/581.1, 582, 776, 779, 769–775, 83/698.11, 782, 746, 513; 30/507, 234, 266, 30/268
See application file for complete search history.

(56) References Cited

U.S. PATENT DOCUMENTS

| | | | | |
|---|---|---|---|---|
| 1,968,021 | A * | 7/1934 | Bettendorf | 83/751 |
| 2,720,228 | A * | 10/1955 | Josef | 83/784 |
| 2,747,631 | A | 5/1956 | Behlefeldt | |
| 3,872,561 | A | 3/1975 | Pomernacki | |
| 3,895,438 | A | 7/1975 | Burkepile et al. | |
| 3,921,489 | A * | 11/1975 | Johansson | 83/779 |
| 4,821,357 | A | 4/1989 | Millette | |
| 5,056,268 | A | 10/1991 | Wolff | |
| 5,099,538 | A | 3/1992 | Gaconnet | |
| 5,694,825 | A * | 12/1997 | Chang | 83/581.1 |
| 5,992,283 | A * | 11/1999 | Chen | 83/662 |
| 6,393,957 | B1 * | 5/2002 | Wang | 83/602 |
| 6,474,211 | B1 * | 11/2002 | Lin | 83/783 |
| 6,725,757 | B1 * | 4/2004 | Chiang | 83/783 |
| 2002/0073822 | A1 * | 6/2002 | Abel | 83/784 |
| 2008/0115367 | A1 | 5/2008 | Glynn | |
| 2012/0066919 | A1 | 3/2012 | Holba et al. | |

FOREIGN PATENT DOCUMENTS

| | | |
|---|---|---|
| DE | 102008027671 | 12/2009 |
| EP | 2382929 A1 | 11/2011 |
| WO | 2008024717 A2 | 2/2008 |

OTHER PUBLICATIONS

International Search Report and Written Opinion in corresponding PCT Application (i.e., PCT/US2011/061882), completed Aug. 24, 2012 (12 pages).

* cited by examiner

*Primary Examiner* — Sean Michalski
(74) *Attorney, Agent, or Firm* — Maginot, Moore & Beck

(57) ABSTRACT

An accessory tool is configured to be coupled to a power tool having a tool drive structure. The accessory tool includes a spring component and has a first arm and a second arm attached to the spring component. The first arm includes (i) a first proximal end portion defining a first accessory drive structure that is configured to mate with a first portion of the tool drive structure, and (ii) a first distal end portion having a first holding structure. The second arm is spaced apart from the first arm and includes (i) a second proximal end portion defining a second accessory drive structure that is configured to mate with a second portion of the tool drive structure, and (ii) a second distal end portion having a second holding structure.

20 Claims, 7 Drawing Sheets

YOKE ACCESSORY TOOL FOR AN OSCILLATING TOOL

FIELD

This invention relates to the field of oscillating power tools, and more particularly to accessory tools for use with oscillating power tools.

BACKGROUND

In general, oscillating tools are light-weight, handheld power tools capable of being equipped with a variety of tool accessories and attachments, such as cutting blades, sanding discs, grinding tools, and many others. These types of tools typically include a generally cylindrically-shaped main body that serves as an enclosure for an electric motor as well as a hand grip for the tool. The electric motor oscillates a tool holder to which any one of various accessory tools may be attached. As the tool holder is oscillated, an accessory tool attached to the tool holder is driven to perform a particular function, such as sanding, grinding, or cutting, depending on the configuration of the accessory tool.

Accessory tools for an oscillating power tool typically have one-piece rigid construction that includes a mounting portion that is used to secure the accessory tool to the tool holder and a tool body extending from the mounting portion that supports a working portion of the accessory tool, such as an abrasive surface or sharp edge. The tool holder of most oscillating power tools includes a tool drive structure that facilitates a secure and rigid connection between the tool holder and the mounting portion of one or more accessory tools. The accessory tools for use with a power tool are provided with an accessory drive structure configured to interlock with the tool drive structure of the corresponding tool holder. The interlocked drive structures enable the accessory tool to be moved with the tool holder while preventing slippage and other relative movement of the accessory tool with respect to the tool holder as the tool holder is oscillated.

Due to a number of factors, such as the high frequency oscillating drive motion, rigid one-piece construction, the compact nature of the power tools and accessories, etc., oscillating power tools are limited in their ability to perform intricate cutting and sanding operations on workpieces. These types of cuts typically require the use of a thin, flexible work element, such as a wire, band, or blade that is placed in tension to perform work on a workpiece. Consequently, applications that require intricate cutting, sanding, or shaping are usually performed with a table or stand mounted power scroll saw, hand coping/fret saw, and the like.

What is needed is an accessory tool for a handheld oscillating power tool that enables a thin, longitudinal work element, such as a wire, band, or blade, to cutting and/or sanding element to be secured to and driven by the tool holder of an oscillating tool.

SUMMARY

In accordance with one embodiment, an accessory tool is provided that is configured to be coupled to a power tool having a tool drive structure. The accessory tool includes a spring component and has a first arm and a second arm attached to the spring component. The first arm includes (i) a first proximal end portion defining a first accessory drive structure that is configured to mate with a first portion of the tool drive structure, and (ii) a first distal end portion having a first holding structure. The second arm is spaced apart from the first arm and includes (i) a second proximal end portion defining a second accessory drive structure that is configured to mate with a second portion of the tool drive structure, and (ii) a second distal end portion having a second holding structure.

In another embodiment, an accessory tool is provided that is configured to be coupled to a power tool having a tool drive structure. The accessory tool includes a spring component having (i) a first mounting face, (ii) a second mounting face, and (iii) a hinge interconnecting the first mounting face and the second mounting face. The accessory tool also includes a first arm and a second arm. The first arm has (i) a first proximal end portion attached to the first mounting face, and (ii) a first distal end portion having a first holding structure. The second arm has (i) a second proximal end portion attached to the second mounting face, and (ii) a second distal end portion having a second holding structure. At least one of the spring, the first proximal end portion, and the second proximal end portion includes an accessory drive structure that is configured to mate with the tool drive structure.

DESCRIPTION

Figure 1:
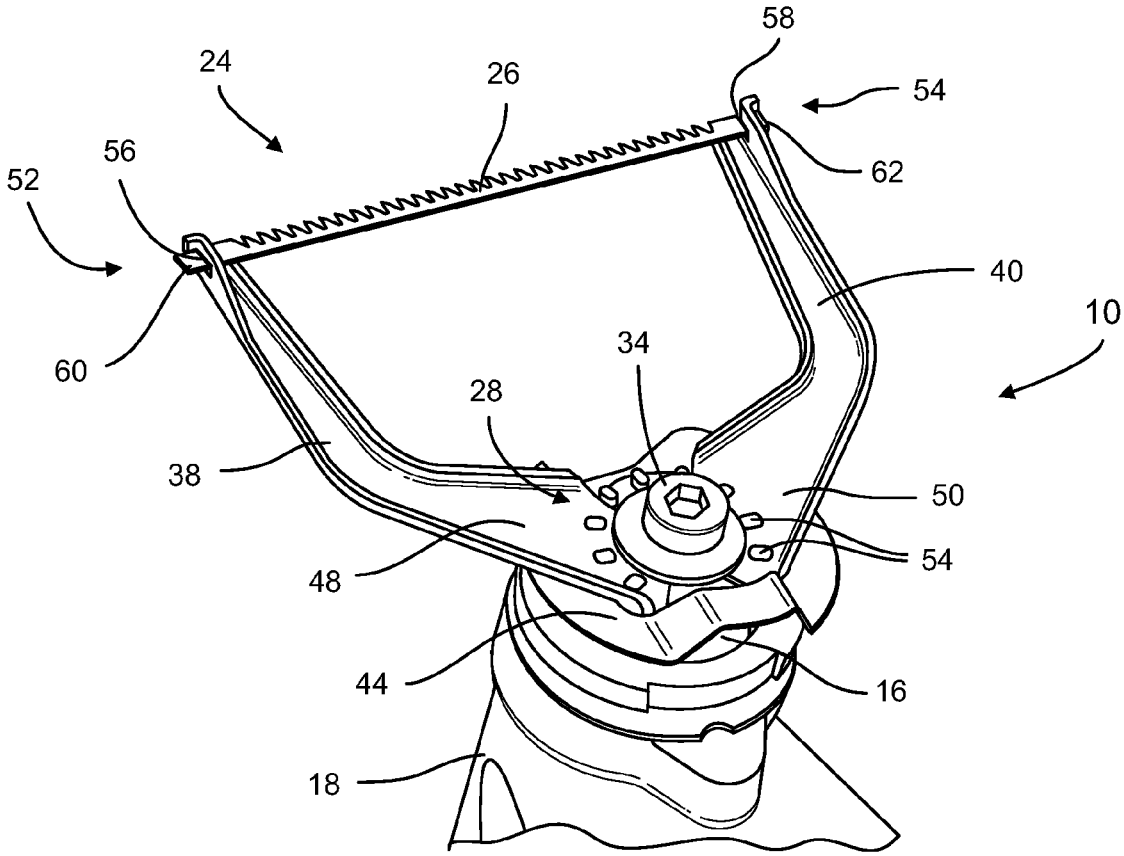
FIG. 1 is a perspective view of a yoke accessory tool mounted on a tool holder of the power tool.
Figure 2A:
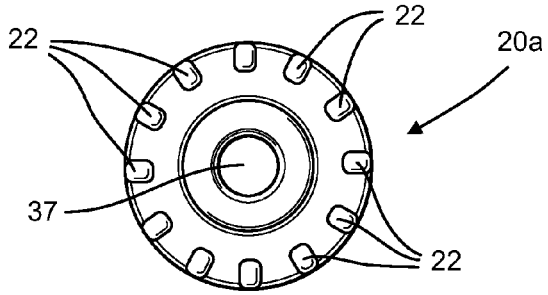
FIGS. 2A-2F depict elevational views of six (6) distinct tool drive structures, respectively, that may be utilized in the power tool of FIG. 1.
Figure 2B:
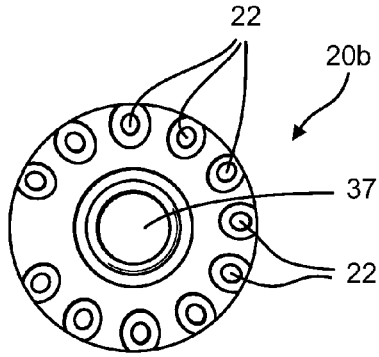
Figure 2C:
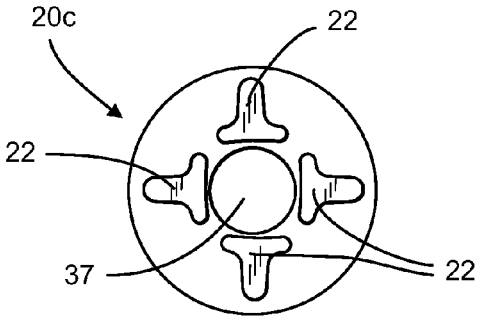
Figure 2D:
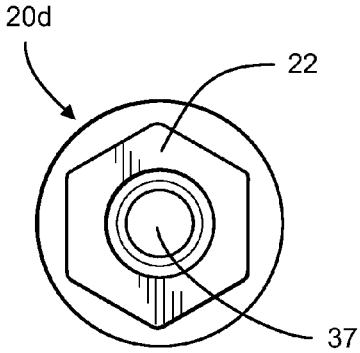
Figure 2E:
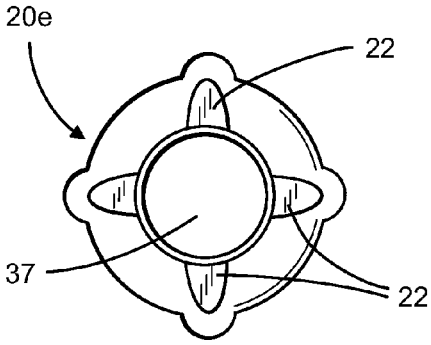
Figure 2F:
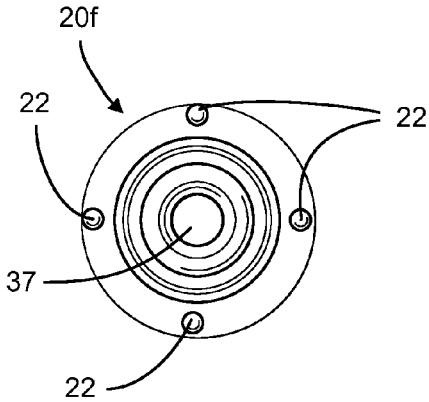

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

Referring to FIG. 1, the present disclosure is directed to a yoke accessory tool 24 which can be mounted to an oscillating power tool and that is configured to releasably retain a thin, longitudinal workpiece contact element 26, such as a wire, band, or blade. As explained below, the yoke accessory tool 24 comprises two bracket arms 38, 40 that are configured to retain a thin, flexible workpiece contact element 26 therebetween. The bracket arms 38, 40 are connected by a flexible spring component 44 that enables the arms 38, 40 to be manually pivoted with respect to each other to allow the desired workpiece contact element 26 to be extended between and secured to each arm. The spring component 44 of the yoke accessory tool is mounted to the tool holder 16 of an oscillating tool 10 using a clamping screw 34 or similar type of structure.

As depicted in FIG. 1, the power tool 10 includes a main body 18 that serves as a hand grip for the tool 10 and a housing for retaining an electric motor (not shown). The electric motor oscillates a tool holder 16 extending from the main body 18 to which various accessory tools may be attached, such as the yoke accessory tool 24. As the tool holder 16 is oscillated, the accessory tool 24 is driven to perform a particular function, such as sanding, grinding, or cutting, depending on the configuration of the workpiece contact element 26. Power for the electric motor is received from a suitable power source (not shown), such as an internal batter supply or a power cord connected to an AC wall outlet.

The tool holder 16 includes a tool drive structure 20 that enables the tool holder 16 to drive the accessory tool 24. As depicted in FIG. 1, the accessory tool 24 includes a s an accessory drive structure 28 that is configured to mate or interlock with the tool drive structure 20 of the tool holder 16. The interlocked drive structures 20, 28 enable the movement imparted to the tool holder 16 by the motor to be used to drive the accessory tool 24 to perform work on a workpiece. FIGS. 2A-2F depict various tool drive structures 20*a*-20*f* that may be incorporated into the tool holder 16 of the power tool 10. Any suitable tool drive structure configuration, including configurations not depicted in FIGS. 2A-2F, may be used. A clamping member 34, such as a clamping screw, is used to press the accessory drive structure 28 of the accessory tool 24 into interlocking engagement with the tool drive structure 20 thus securing the accessory tool 24 to the tool holder 16. In one embodiment, the tool holder 16 includes a threaded bore 30 configured to mesh with the longitudinal threaded portion of the clamping screw 34.

Referring now to FIGS. 3-10, the yoke accessory tool 24 includes a pair of bracket arms 38, 40 that are configured to support the workpiece contact element 26 therebetween. Each bracket arm 38, 40 is formed of a sturdy rigid material such as stainless steel although any suitable material may be used. Each bracket arm 38, 40 includes a proximal end portion 48, 50, and a distal end portion 52, 54 that is spaced apart from the spring component 44. The distal end portions 52, 54 of the bracket arms 38, 40 each include a holding structure 56, 58 configured to retain a portion of a workpiece contact element 26 to enable the workpiece contact element 26 to be supported by the bracket arms 38, 40.

Figure 6:
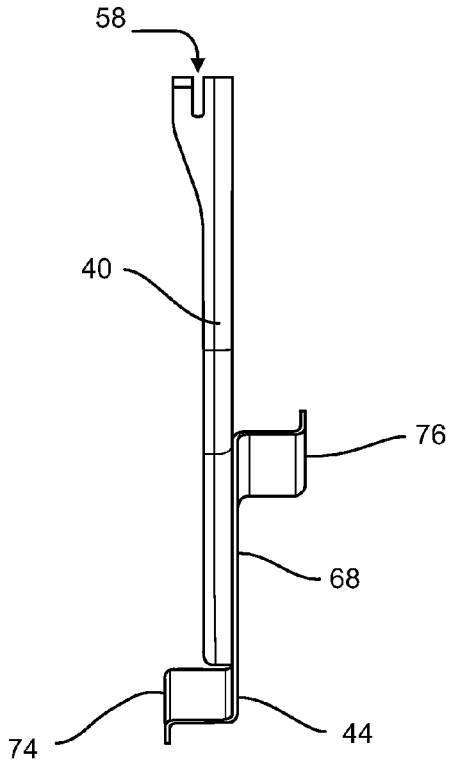
FIG. 6 is a side elevational view of the yoke accessory tool shown in FIG. 1.
Figure 13:
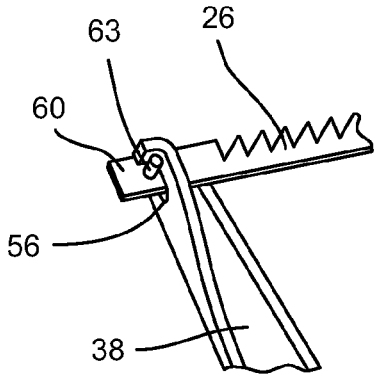
FIG. 13 is a perspective view showing the connection between a bracket arm of the yoke accessory tool and an end of a cutting blade accessory.
Figure 14:
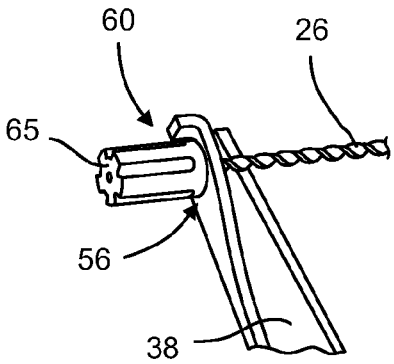
FIG. 14 is a perspective view showing the connection between a bracket arm of the yoke accessory tool and an end of a cutting wire accessory.

Any suitable holding structure 56, 58 may be used to releasably attach a workpiece contact element 26 to the bracket arms. As best seen in FIG. 6, the holding structures 56, 58 of the bracket arms 38, 40 comprise slots sized to receive the end segments 60, 62 of the workpiece contact element 26. In the embodiment of FIG. 1, the workpiece contact element 26 comprises a blade that includes end segments 60, 62. One method that may be used to releasably secure the end segments 60, 62 of the blade to the slots 56, 58 is to extend a pin 63, or similar type of structure, through the end segments 60, 62 at locations outboard of the slots 56, 58 as depicted in FIG. 13. The workpiece contact element 26 may also comprise a wire or filament. The end segments 60, 62 of a wire or filament contact element may be secured to the slots 56, 58 of the bracket arms using a wire crimper 65 at the end segments 60, 62 of the wire outboard of the slots 56, 58 as depicted in FIG. 14.

The yoke accessory tool 24 is configured such that the bracket arms 38, 40 position the workpiece contact element 26 a predetermined distance D away from the spring component 44 in a direction E. In addition, the bracket arms 38, 40 are configured to space the holding structures apart from each other by a predetermined distance F. The distance D is selected to provide adequate clearance for the workpiece contact element 26 to be driven to perform work on a workpiece without being impeded by the main body 18 of the power tool 10. The distance F is selected to maintain a predetermined tension along the workpiece contact element 26 that enables the workpiece contact element 26 to be used to perform a particular function, such as cutting, sanding, and shaping operations on a workpiece.

Figure 10:
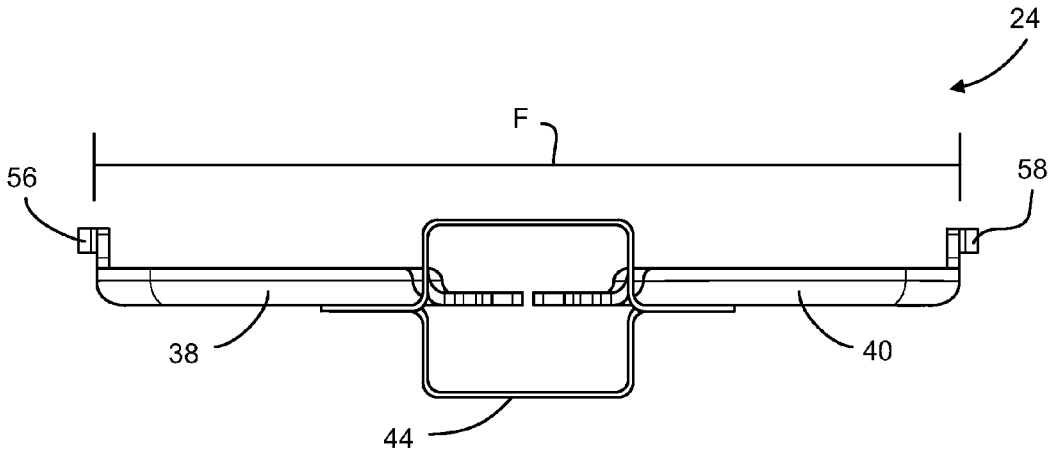
FIG. 10 is an end elevational view of the yoke accessory tool shown in FIG. 1 in a tensioned position.
Figure 11:
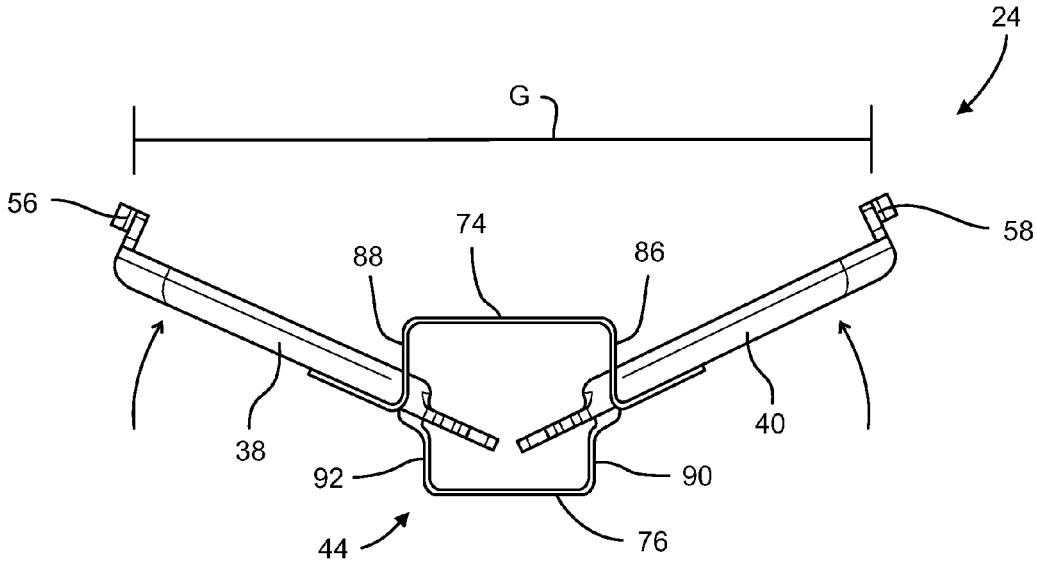
FIG. 11 is an end elevational view of the yoke accessory tool shown in FIG. 1 in a flexed position.

To enable the end segments 60, 62 to be inserted into the slots 56, 58 of the bracket arms, the mounting portion 44 comprises a spring component 44 that enables each of the bracket arms 38, 40 to be manually pivoted or flexed between a tensioned position as depicted in FIG. 10 in which the holding structures 56, 58 are spaced the distance F apart and a flexed position as depicted in FIG. 11 in which the holding structures 56, 58 are spaced a distance G apart. The distance G enables the end segments 60, 62 of the workpiece contact element 26 to be placed in contact with the holding structures 56, 58 to secure the workpiece contact element 26 to the bracket arms 38, 40.

Figure 7:
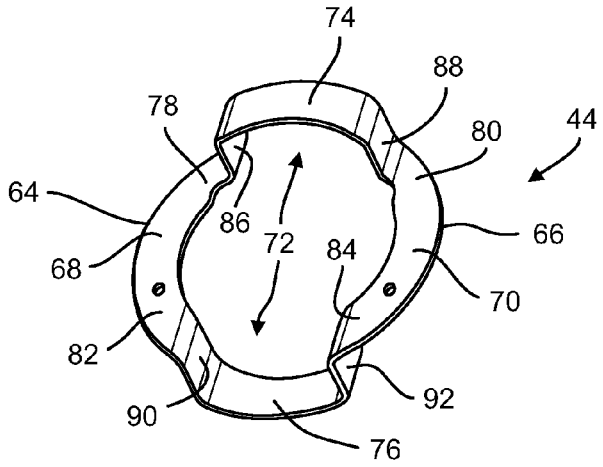
FIG. 7 is a perspective view of the spring component of the yoke accessory tool shown in FIG. 1.
Figure 8:
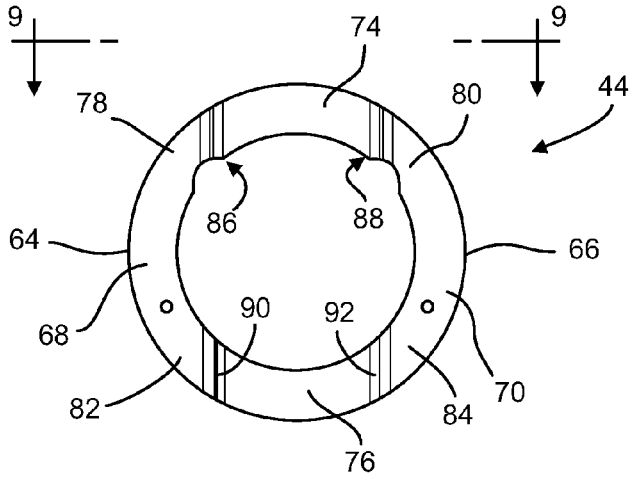
FIG. 8 is an elevational view of the spring component of the yoke accessory tool shown in FIG. 1.
Figure 9:
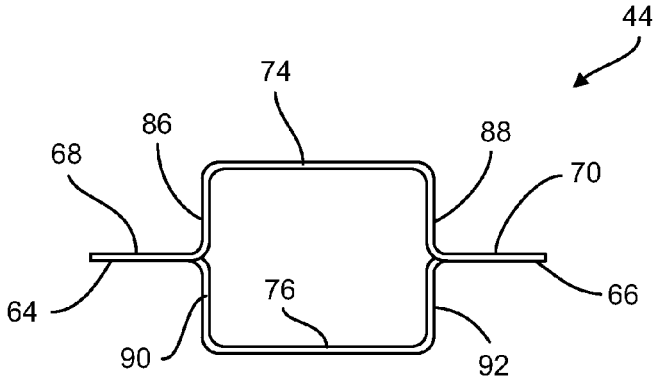
FIG. 9 is an end elevational view of the spring component of the yoke accessory tool of FIG. 1.

As depicted in FIGS. 7-9, the spring component 44 comprises a first mounting portion 64 and a second mounting portion 66 interconnected by a hinge structure 72. The first mounting portion 64 has a first mounting face 68 to which the first bracket arm 38 is secured and the second mounting portion 66 has a second mounting face 70 to which the second bracket arm 40 is secured. In the embodiment of FIGS. 3-10, the bracket arms 28, 30 are secured to the mounting portions 64, 66 of the spring component 44 by welding. In alternative embodiments, the bracket arms 28, 30 may be secured to the mounting portions 64, 66 in any suitable manner, such as by fasteners or an adhesive.

Figure 3:
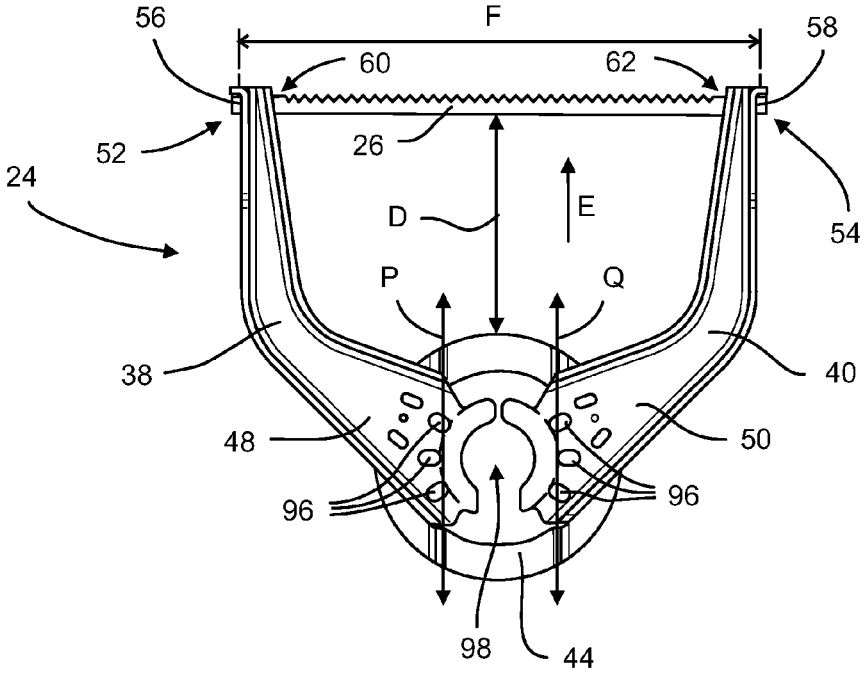
FIG. 3 is a top elevational view of the yoke accessory tool shown in FIG. 1.
Figure 4:
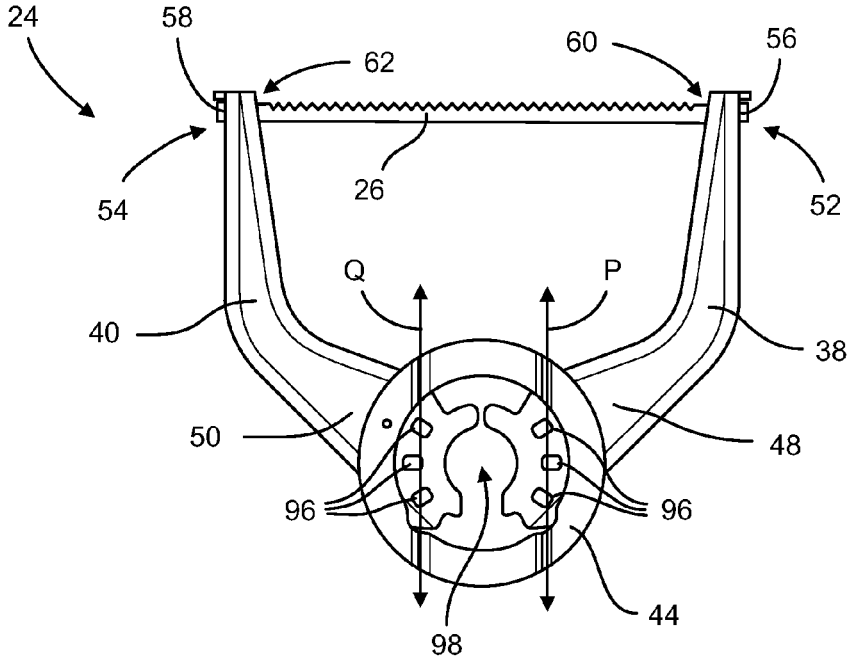
FIG. 4 is a bottom elevational view of the yoke accessory tool shown in FIG. 1.
Figure 5:
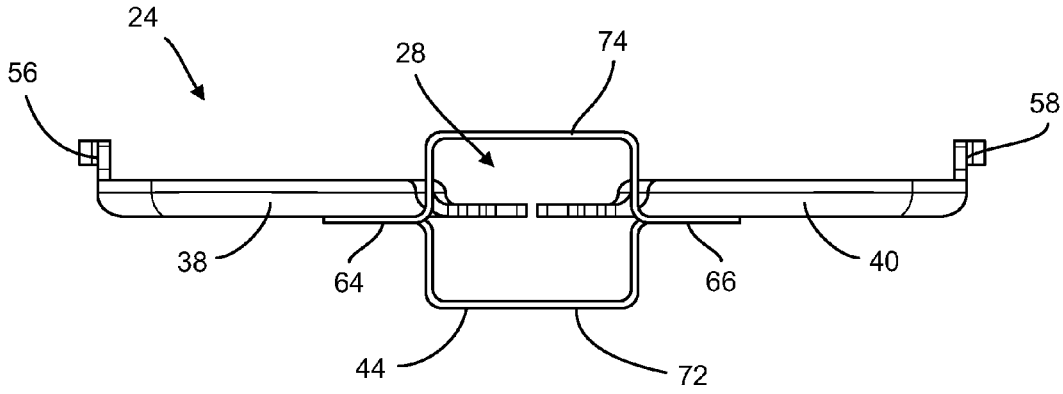
FIG. 5 is an end elevational view of the yoke accessory tool shown in FIG. 1.

The mounting portions 64, 66 and the hinge structure 72 cooperate to define a respective pivot axis P, Q for each mounting portion about which the corresponding mounting portion 64, 66 pivots or flexes. Referring to FIGS. 3 and 4, the configuration of the hinge structure 72 of the spring component 44 enables each pivot axis P, Q to be oriented substantially in the direction of extension E of the bracket arms 38, 40. Consequently, as the mounting portions 64, 66 and the corresponding bracket arms 38, 40 are pivoted about the respective pivot axis P, Q, the holding structures 56, 58 are moved in an arcing path about each respective pivot axis P, Q and. The arcing path of movement of the holding structures at least in part enables the holding structures 56, 58 to be moved between a first relative position with respect to each other at which the holding structures 56, 58 are the distance F apart from each other and a second relative position with respect to each other at which the holding structures 56, 58 are the distance G apart from each other.

To facilitate the movement of the mounting portions 64, 66 with respect to the hinge structure 72 about the respective pivot axis P, Q between the tensioned position (FIG. 10) and the flexed position (FIG. 11), the hinge structure 72 includes a first hinge portion 74 that extends between the first end regions 78, 80 of the mounting portions 64, 66, and a second hinge portion 76 that extends between the second end regions 82, 84 of the mounting portions (opposite from the first end regions 78, 80).

The first hinge portion 74 includes a section 86 that extends substantially perpendicularly from the first end region 78 of the first mounting portion 64 and a section 88 that extends substantially perpendicularly from the first end region 80 of the second mounting portion 66. Similarly, the second hinge portion 76 includes a section 90 that extends substantially perpendicularly from the second end region 82 of the first mounting portion 64 and a section 92 that extends substantially perpendicularly from the second end region 84 of the second mounting portion 66. The perpendicular sections 86, 88 of the hinge portions extend in opposite directions from the respective end regions 78, 80 of mounting portion 64, 66, and the perpendicular sections 90, 92 of the hinge portions 74, 76 extend in opposite directions from the respective end regions 82, 84 of the mounting portions 64, 66. The perpendicular sections 86, 88 and the first mounting portion 64 cooperate to define the pivot axis P, and the perpendicular sections 90, 92 and the second mounting portion 66 cooperate to define the pivot axis Q.

Figure 12:
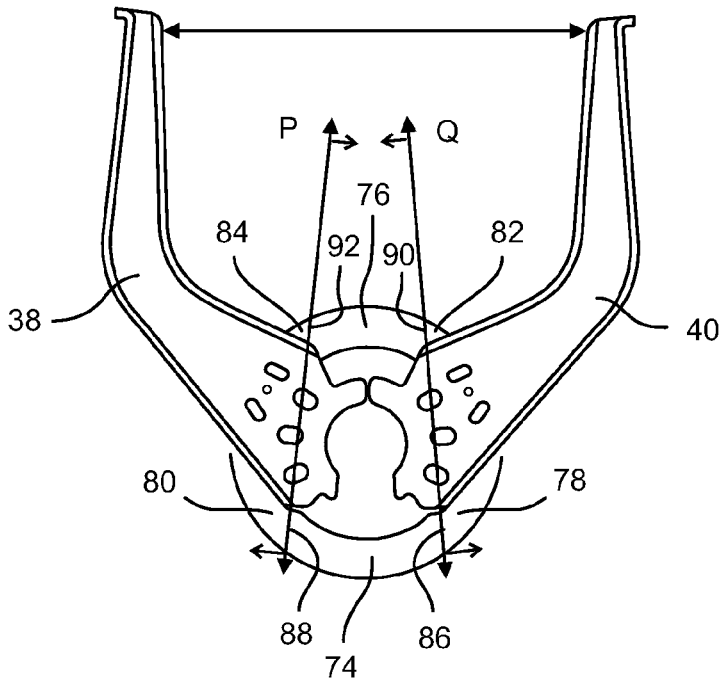
FIG. 12 is a top elevational view of the yoke accessory tool in the flexed position.

Due to the configuration of the hinge portions 74, 76, pivoting or flexing the bracket arms about the respective pivot axes P, Q causes a contraction in the area of the spring component 44 facing in the direction of extension E and an expansion in the area of the spring component 44 facing opposite the direction E. As depicted in FIG. 11, the hinge portion 76 and sections 90, 92 of the hinge portion 76 bend in response to the pivoting or flexing of the bracket arms which allows the end regions 82, 84 to contract and move closer together. The hinge portion 74 and sections 86, 88 of the hinge portion 74 bend in response to the pivoting or flexing of the bracket arms which allows the end regions 78, 80 to expand and move farther apart from each other. As depicted in FIG. 12, this opposed contraction and expansion of the spring component 44 skews the pivot axes P, Q toward each other in the direction E which in turn brings the holding structures 56, 58 closer together for removing and/or attaching a workpiece contact element.

Referring now to FIGS. 3 and 4, the accessory drive structure 28 for the yoke accessory tool 24 is defined by the proximal end portions 48, 50 of the bracket arms 38, 40. As depicted, the proximal end portions 48, 50 of the bracket arms 38, 40 cooperate to define at least a portion of a central opening 98 though which the longitudinal portion of the clamping screw 34 is passed on the way to the central bore 37 (See FIG. 2A) of the tool holder 16. The tool drive structure 20 comprises a plurality of projections 22 arrayed about the central bore 37 of the tool holder (See FIG. 2A). The accessory drive structure 28 comprises a plurality of drive openings 96 that are sized and positioned complementary to at least some of the projections 22. The drive openings 96 are distributed between the end portions 48, 50 of the bracket arms with the first proximal end portion 48 of the first bracket arm 28 defining a first portion of the drive openings 96 and the second proximal end portion 50 of the second bracket arm defining a second portion of the drive openings 96. The number of drive openings incorporated into each end portion 48, 50 may be the same although not necessarily. In addition, the total number of drive openings 96 does not have to correspond to the total number of projections 22 as any suitable number of drive openings 96 may be provided that enables the tool drive structure 20 and the accessory drive structure 28 to be interlocked and provide a secure connection.

The spring component 44 positions the proximal end portions 48, 50 of the bracket arms with respect to each other so that the central opening 98 and the drive openings 96 are aligned with the central bore 37 and projections 22 of the tool drive structure 20. With the central opening 98 aligned with the central bore 37 and the drive openings 96 aligned with the projections of the tool drive structure 20, the clamping screw may be threaded into the bore 30. As the clamping screw 34 is tightened, the proximal end portions 48, 50 of the bracket arms are pressed into engagement with the tool holder thereby securing an interlocked relationship between the tool drive structure 20 and the accessory drive structure 28, and securing the bracket arms 28, 30 in the tensioned position with respect to each other.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. An accessory tool configured to be coupled to a power tool having a tool drive structure, the accessory tool comprising:

a spring component;

a first arm attached to said spring component, said first arm including (i) a first proximal end portion defining a first accessory drive structure that is configured to mate with a first portion of said tool drive structure, and (ii) a first distal end portion having a first holding structure; and a second arm spaced apart from said first arm and attached to said spring component, said second arm including (i) a second proximal end portion defining a second accessory drive structure that is configured to mate with a second portion of said tool drive structure, and (ii) a second distal end portion having a second holding structure.

2. The accessory tool of claim 1, further comprising a work piece contact element extending between said first holding structure and said second holding structure.

3. The accessory tool of claim 2, wherein said work piece contact element includes:

a first end segment positioned in contact with said first holding structure, and a second end segment positioned in contact with said second holding structure.

4. The accessory tool of claim 3, wherein:

said first holding structure defines a first slot in which said first end segment of said work piece contact element is positioned, and said second holding structure defines a second slot in which said second end segment of said work piece contact element is positioned.

5. The accessory tool of claim 2, wherein said work piece contact element includes a blade, wherein:

said blade includes a first blade end portion and a second blade end portion, said first blade end portion is positioned in contact with said first holding structure, and said second blade end portion is positioned in contact with said second holding structure.

6. The accessory tool of claim 2, wherein said work piece contact element includes one of a blade and a wire.

7. The accessory tool of claim 1, wherein:

said first proximal end portion of said first arm is secured to a first part of said spring component, and said second proximal end portion of said second arm is secured to a second part of said spring component.

8. The accessory tool of claim 1, wherein:

said first accessory drive structure defines a first number of drive openings, and said second accessory drive structure defines a second number of drive openings.

9. The accessory tool of claim 8, wherein:

said spring component is configured to define a central opening, said first number of drive openings is aligned with said central opening, and said second number of drive openings is also aligned with said central opening.

10. The accessory tool of claim 1, wherein said spring component includes:

a first mounting face defining a first face end portion and a second face end portion, a second mounting face spaced apart from said first mounting face and defining a third face end portion and a fourth face end portion, a first hinge portion interconnecting said first face end portion and said third face end portion, a second hinge portion spaced apart from said first hinge portion and interconnecting said second face end portion and said fourth face end portion, said first arm is attached to said first mounting face, and said second arm is attached to said second mounting face.

11. The accessory tool holder of claim 10, wherein:

both of said first hinge portion and said second hinge portion are configured to flex, and said accessory tool is configured such that flexing of said first hinge portion and said second hinge portion causes said first holding structure and said second holding structure to move in relation to each other.

12. The accessory tool of claim 10, wherein:

said first arm is welded to said first mounting face, and said second arm is welded to said second mounting face.

13. An accessory tool configured to be coupled to a power tool having a tool drive structure, the accessory tool comprising:

a spring component having (i) a first mounting face, (ii) a second mounting face, and (iii) a hinge interconnecting said first mounting face and said second mounting face;

a first arm having (i) a first proximal end portion attached to said first mounting face, and (ii) a first distal end portion having a first holding structure; and a second arm having (i) a second proximal end portion attached to said second mounting face, and (ii) a second distal end portion having a second holding structure, wherein at least one of said spring, said first proximal end portion, and said second proximal end portion includes an accessory drive structure that is configured to mate with said tool drive structure.

14. The accessory tool of claim 13, wherein:

said hinge includes a first hinge portion and a second hinge portion, said first mounting face defines a first face end portion and a second face end portion, said second mounting face defines a third face end portion and a fourth face end portion, said first hinge portion interconnects said first face end portion and said third face end portion, and said second hinge portion interconnects said second face end portion and said fourth face end portion.

15. The accessory tool of claim 13, further comprising a work piece contact element extending between said first holding structure and said second holding structure.

16. The accessory tool of claim 15, wherein said work piece contact element includes one of a blade and a wire.

17. The accessory tool of claim 13, wherein:

said first arm includes said accessory drive structure, said accessory drive structure defines a first number of drive openings, said spring component is configured to define a central opening, said first number of drive openings is aligned with said central opening.

18. The accessory tool of claim 17, wherein:

said second arm includes an additional accessory drive structure that defines a second number of drive openings.

said second number of drive openings is also aligned with said central opening.

19. The accessory tool holder of claim 13, wherein:

said hinge is configured to flex, and said accessory tool is configured such that flexing of said hinge causes said first holding structure and said second holding structure to move in relation to each other.

20. The accessory tool of claim 13, wherein:

said first proximal end portion of said first arm is welded to said first mounting face, and said second proximal end portion of said second arm is welded to said second mounting face.

* * * * *